US006354887B2

(12) United States Patent
Maeda

(10) Patent No.: US 6,354,887 B2
(45) Date of Patent: Mar. 12, 2002

(54) CONNECTOR CONNECTING STRUCTURE

(75) Inventor: Akira Maeda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/768,334

(22) Filed: Jan. 25, 2001

(30) Foreign Application Priority Data

Jan. 31, 2000 (JP) ..... 2000-021369

(51) Int. Cl.[7] ..... H01R 13/502
(52) U.S. Cl. ..... 439/701; 439/717
(58) Field of Search ..... 439/701, 717

(56) References Cited

U.S. PATENT DOCUMENTS 6,000,971 A * 12/1999 Hatagishi et al. ..... 439/701
6,007,386 A * 12/1999 Okabe ..... 439/701
6,129,593 A * 10/2000 Aoyama et al. ..... 439/701

FOREIGN PATENT DOCUMENTS

JP H4-96976 8/1992
JP 10-189122 7/1998

* cited by examiner

*Primary Examiner*—Khiem Nguyen
(74) *Attorney, Agent, or Firm*—Finnegan, Henderson, Farabow, Garrett & Dunner, L.L.P.

(57) ABSTRACT

A connector connecting structure of the present invention comprises: first connecting means 11 having a first engaging projection 14 provided on one of connector housings 2 and 3 and having a tapered portion 21 on the side of a wall 19 of a head 20, a first locking portion 16 provided on the other surface of the other connector housing 3 and the tapered portion 21 being locked to the first locking portion 16; and second connecting means 12 having a second engaging projection 24 provided on one surface of the connector housing 2 and including a hook 27, and a second locking portion 26 provided on the other surface of the other connector housing 3 opposed to any one surface of the one connector housing 2 and having a locking surface 29 that is perpendicular to a direction to an engaging direction, the hook 27 is locked to the second locking portion 26 in a state in which the connector housings 2 and 3 are laminated on each other.

3 Claims, 7 Drawing Sheets

CONNECTOR CONNECTING STRUCTURE

BACKGROUND OF THE INVENTION

1. Field of the Invention

The present invention relates to a connector connecting structure for connecting a plurality of laminated connector housings.

2. Description of the Related Art

FIG. 1 shows a conventional connector connecting structure disclosed in Japanese Utility Model Application Laid-open No. H4-96976.

As shown in FIG. 1, in order to connect joint boxes 109, 111 and 113 put on connected portions of electric wires 101 to 107 to one another, each of the joint boxes 109, 111 and 113 is provided at its one of mating surfaces with a dovetail groove 115, and provided at the other mating surface with a projection 117. A cross section of the dovetail groove 115 has such a shape that a width of an opening of the dovetail groove 115 is narrow, a width of the groove bottom is wide, and side walls of the groove are formed into inclined surfaces. Whereas, a cross section of the projection 117 has such a shape that a width of its tip end is wide and its base end is narrow, and the cross sectional shape of the projection 117 corresponds to that of the groove 115.

By inserting the projections 117 into the grooves 115 in the longitudinal direction thereof, the joint boxes 109, 111 and 113 are connected to one another without rattle.

However, according to such a structure, when an external force pulling the connected joint boxes 109, 111 and 113 apart from one another is applied, since strength of triangular projecting portions of the dovetail groove 115 and the projection 117 in their widthwise direction is insufficient, there is a problem that a holding force of the connection is weak, and the connected portion is easily disconnected.

SUMMARY OF THE INVENTION

Thereupon, it is an object of the present invention to provide a connector connecting structure capable of strongly holding connected connector housings without rattle.

To achieve the above object, according to a first aspect of the invention, there is provided a connector connecting structure for connecting a plurality of connector housings to be laminated, comprising: first connecting means comprising a first engaging projection having an enlarged head formed on a tip end of a wall projecting from one surface of one of the connector housings and having a tapered portion formed on the side of the wall, and a first locking portion provided on the other surface of the other connector housing opposed to the one surface of the one connector housing and the tapered portion being locked to the first locking portion in a state in which the connector housings are laminated on each other; and a second connecting means comprising a second engaging projection provided on one surface of any one of the connector housings and having a hook, and a second locking portion provided on the other surface of the other connector housing opposed to one surface of any one of the connector housings, the hook being locked to the second locking portion in a state in which the connector housings are laminated on each other, the second locking portion having a locking surface perpendicular to an engaging direction.

According to this connector connecting structure, if the plurality of connector housings are laminated on one another, the connector housings are connected to one another and coalesced by means of first and second connecting means. In this case, since the first connecting means is so-called dovetail groove connecting means in which the tapered portion of the first engaging projection is locked to the first locking portion, the connector housings are connected to each other without rattle. Further, since the second connecting means is so-called normal connecting means in which the hook of the second engaging projection is locked to the locking surface of the second locking portion, the laminated connector housings are strongly connected. Therefore, the connector housings can be strongly held without rattle.

According to a second aspect of the invention, in the connector connecting structure of the first aspect, the first and second connecting means are provided on front and rear ends of the connector housings in a state in which the first and second connecting means are adjacent to each other.

With this connector connecting structure, if an external force for trying to separate the laminated connector housings is applied from any direction, since the first connecting means, the second connecting means, as well as the first connecting means and the second connecting means are disposed adjacent to each other on the side of the front ends and rear ends of the connector housings, these connector housings are not separated.

According to a third aspect of the invention, in the connector connecting structure of the second aspect, the first connecting means on the side of the front end of the connector housing is formed longer along a widthwise direction of the connector housing, and the second connecting means on the side of the rear end is formed longer along a longitudinal direction of the connector housing.

With this connector connecting structure, the front end side first connecting means is formed longer along the widthwise direction of the connector housings, and the rear end second connecting means is formed longer in the longitudinal direction of the connector housings. Therefore, the number of locking portions between the first engaging projection and the first locking portion as well as between the second engaging projection and the second locking portion is increased, a resistance range with respect to the external force is increased correspondingly and thus, the rattle-preventing force and the holding force can be enhanced.

DESCRIPTION OF THE PREFERRED EMBODIMENT

An embodiment of the present invention will be explained below based on the drawings.

Figure 1:
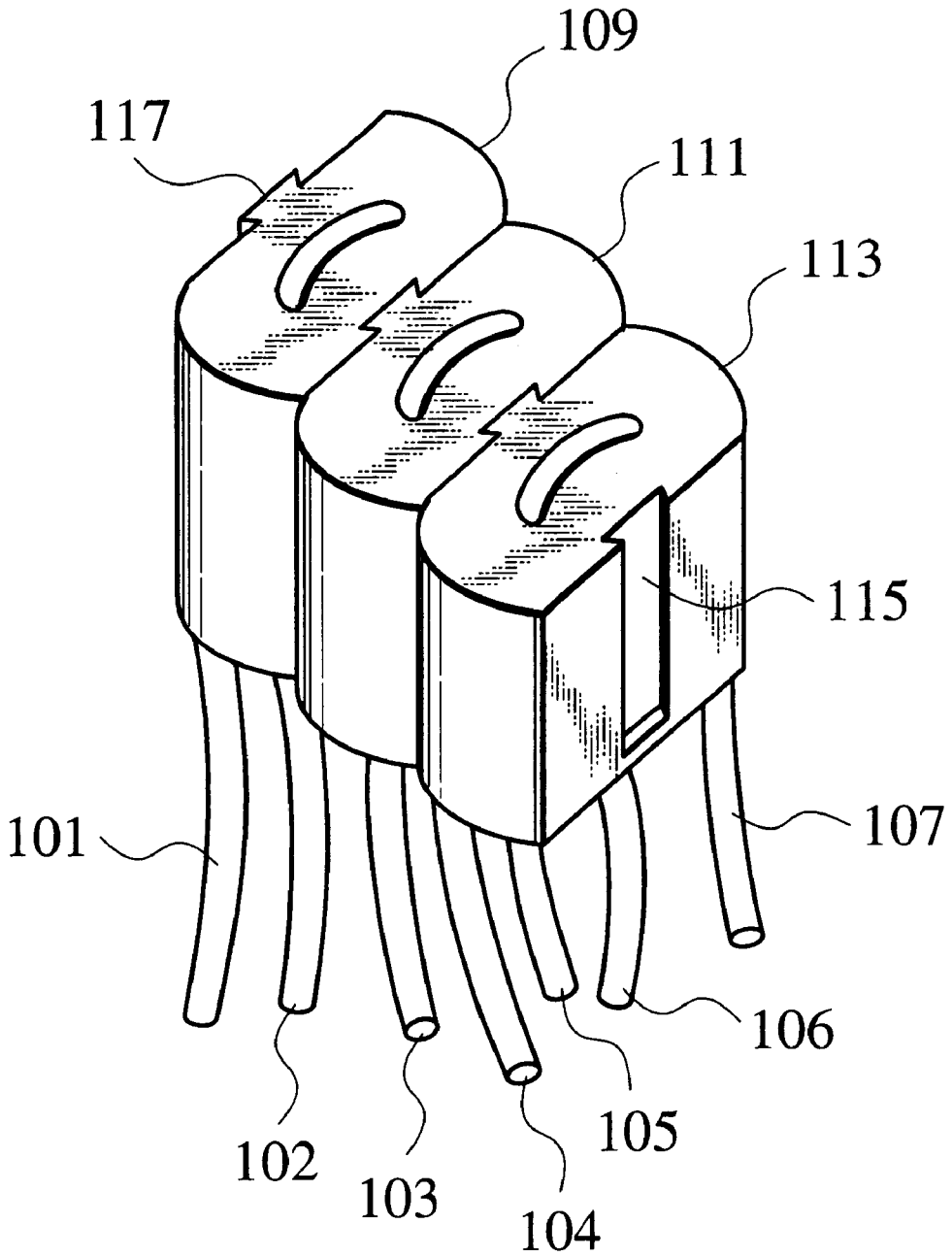
FIG. 1 is a perspective view of prior art.
Figure 2:
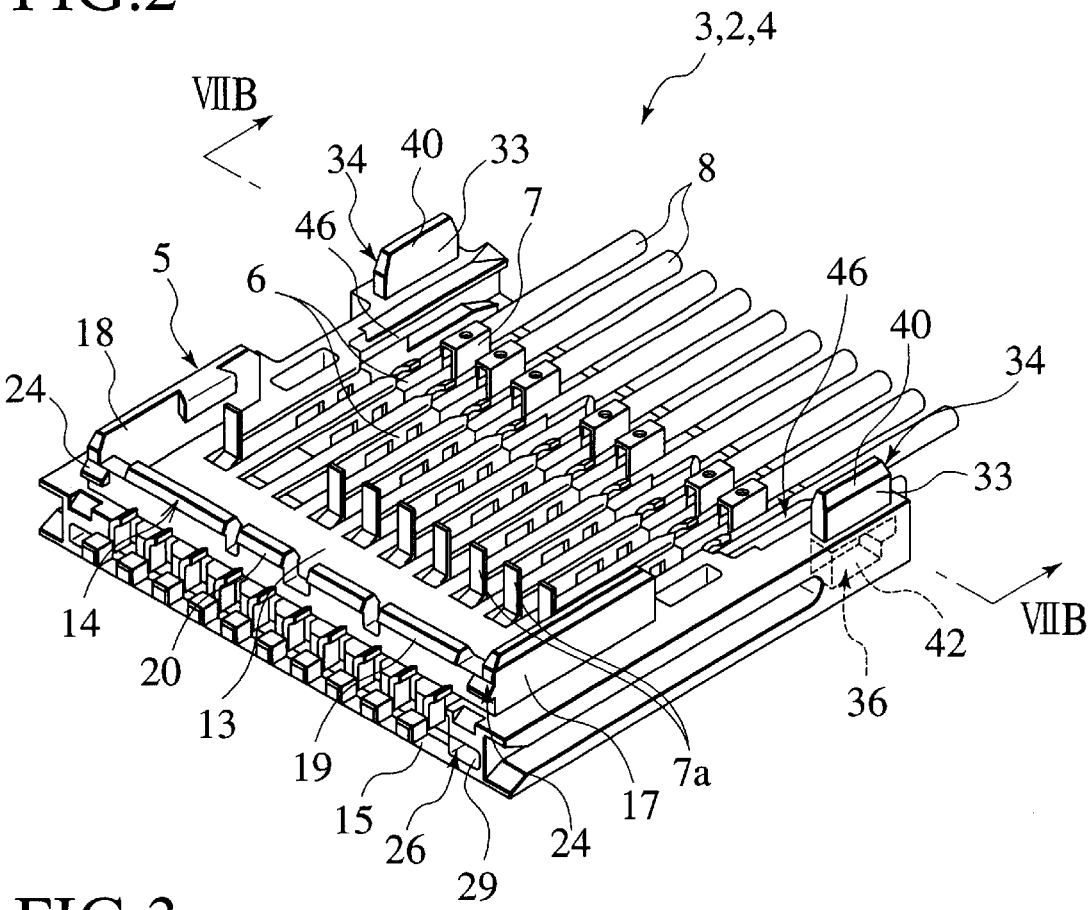
FIG. 2 is a perspective view of an entire connector housing of an embodiment of the present invention.
Figure 3:
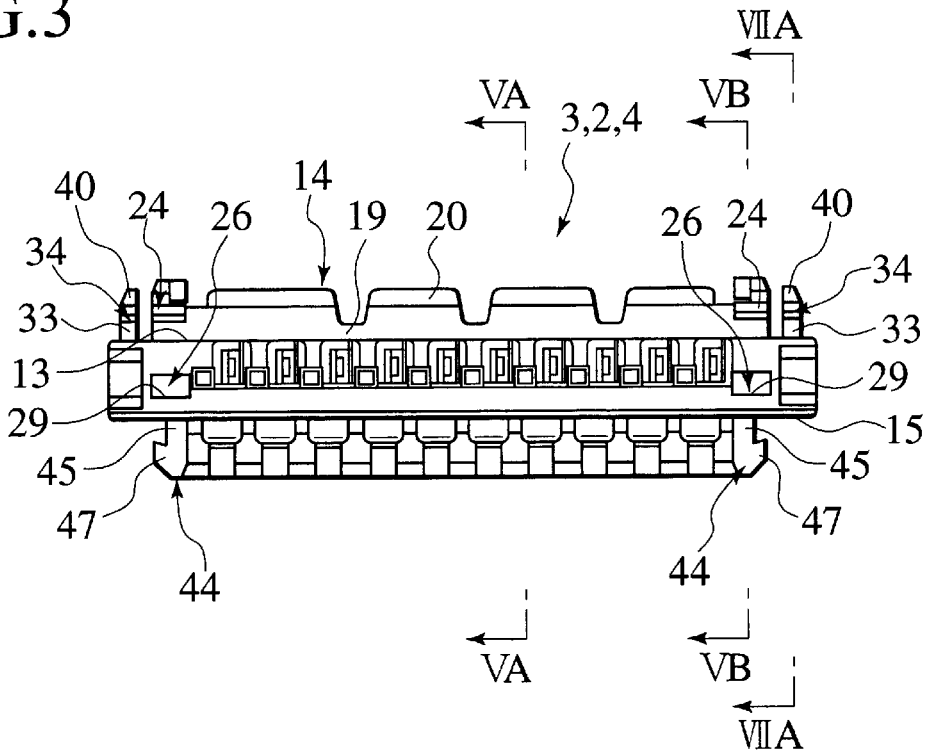
FIG. 3 is a front view of the connector housing of the embodiment of the invention.
Figure 4:
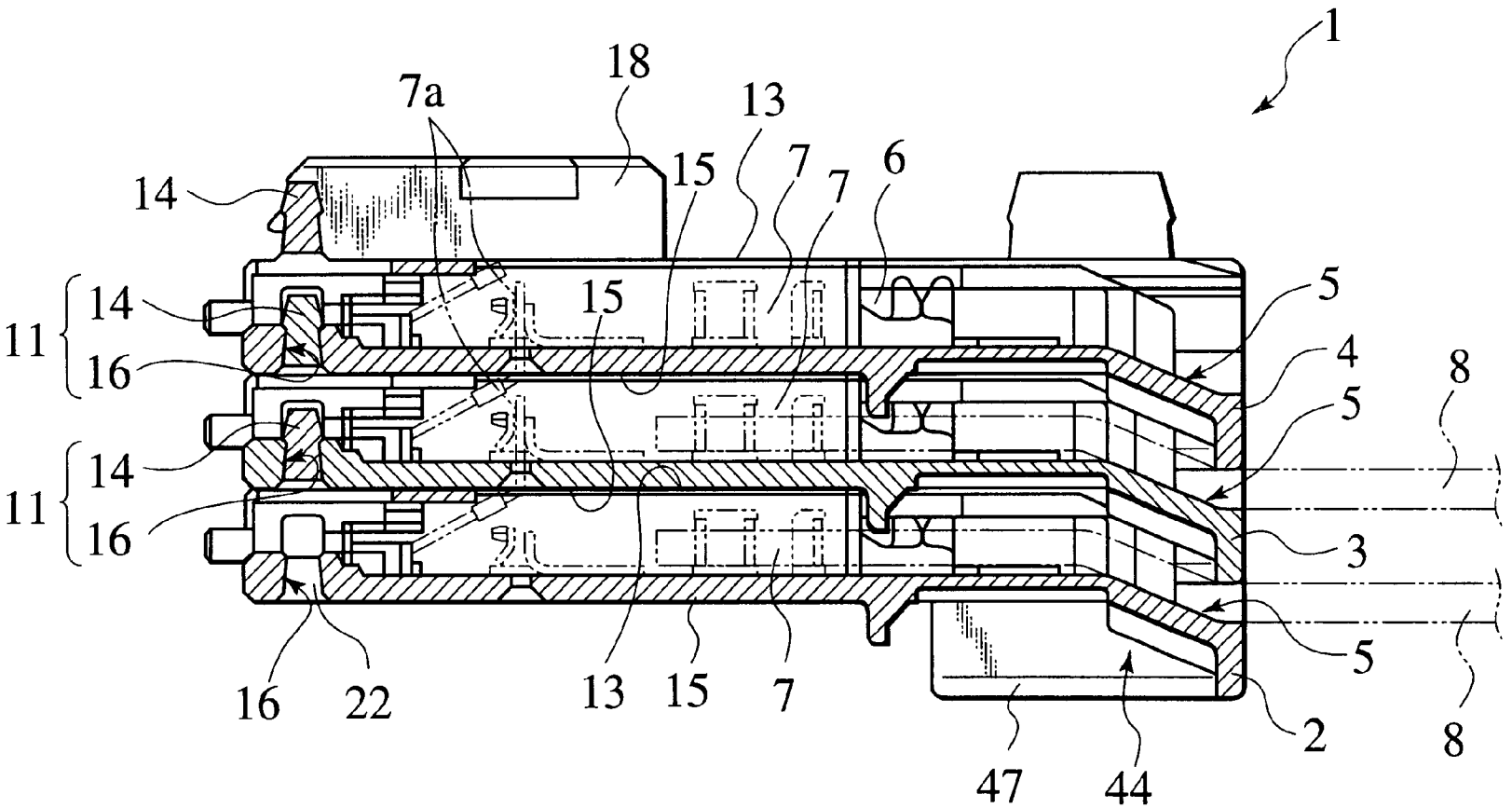
FIG. 4 is a sectional view showing a connector in which connector housings are laminated on and connected to one another.

As shown in FIGS. 2 to 4, in a connector housing 2, a plurality of terminal accommodating grooves 6 are formed side-by-side on an upper surface of a housing body 5. A pressure welded terminal 7 is accommodated in each of the terminal accommodating grooves 6. An electric wire 8 is connected to a pressure welded portion of the pressure welded terminal 7. The pressure welded terminal 7 is formed with an upwardly bent rising terminal 7*a*. As shown in FIG. 4, the rising terminal 7*a* is connected to the pressure welded terminal 7 accommodated in a connector housing 3 or 4 located above the rising terminal 7*a* in a state in which the plurality of connector housings 2, 3 and 4 are joined to and connected to one another.

The plurality of connector housings 2, 3 and 4 (three housings in FIG. 4) are joined to and connected to one another in a state in which joint surfaces 13 and 15 are joined to each other, the connector housings 2 and 3 as well as the connector housings 3 and 4 are connected to each other and coalesced by means of first and second connecting means 11 and 12 located on front ends of the connector housings 2 and 3, and by means of first and second connecting means 31 and 32 located in rear ends of the connector housings 2 and 3. The front end side first and second connecting means and the rear and side first and second connecting means are respectively provided on front end side and rear end side of the adjacent connector housings 2 and 3, or the adjacent connector housings 3 and 4.

The first and second connecting means 11 and 12 provided on front end sides of the connector housings 2 and 3 will be first explained. The connector housings 3 and 4 are also connected to each other by means of the first connecting means 11 and 31 and by means of the second connecting means 12 and 32.

Figure 5A:
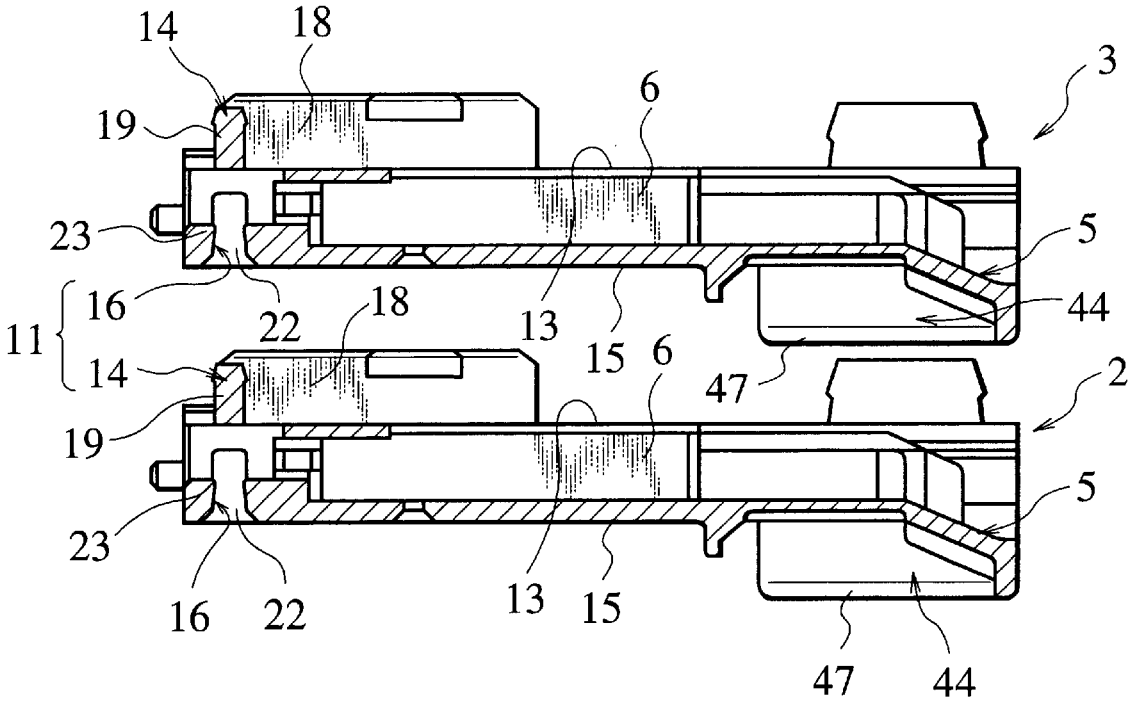
FIG. 5A is a sectional view taken along a VA—VA line in FIG. 3 for showing a state before the connector housings are laminated on one another.
Figure 6A:
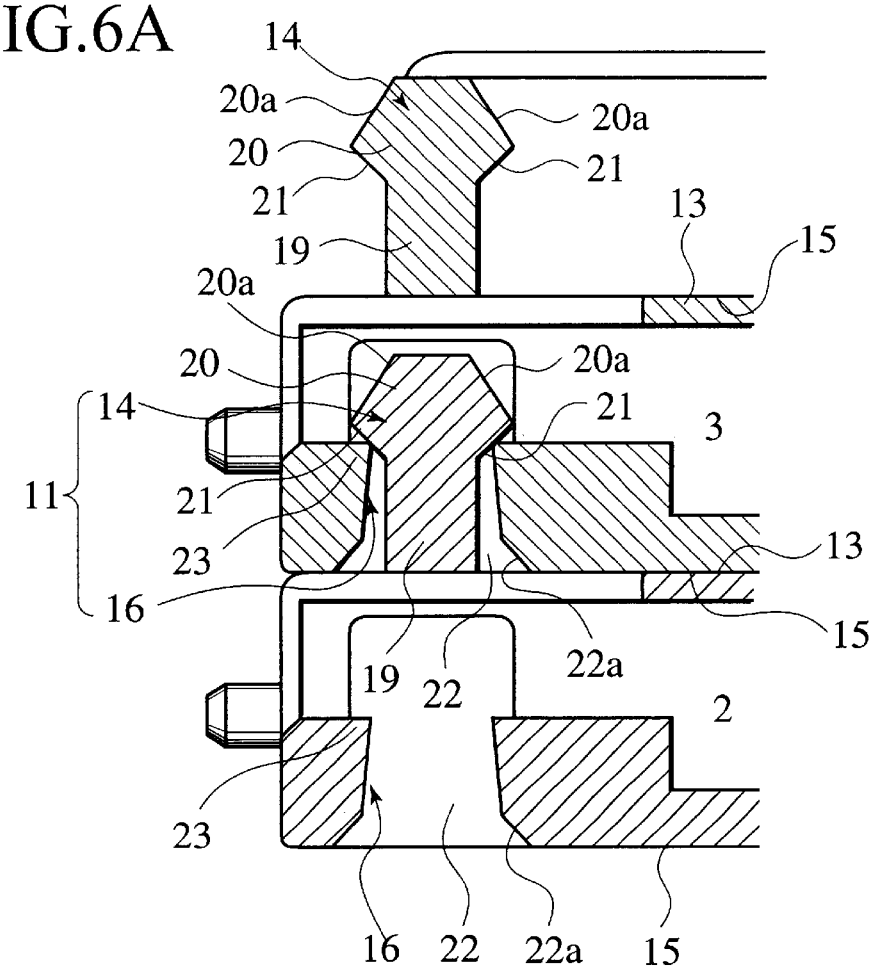
FIG. 6A is a sectional view showing first connecting means closer to a front end of the connector housing and showing a state in which the connector housings are laminated.

As shown in FIG. 5A, the first connecting means 11 comprises a first engaging projection 14 projecting from a joint surface 13 of one of the joined connector housings (lower connector housing 2) and a first locking portion 16 provided on a joint surface 15 of the other connector housing (upper connector housing 3). As shown in FIGS. 5A and 6A, the first engaging projection 14 includes a bank-like wall 19 rising from the front end of the connector housing 2, an enlarged head 20 integrally formed on a tip end of the wall 19, and a tapered portion 21 provided on the side of the wall 19 of the head 20. A guide slant 20*a* is provided on the tip end of the head 20. The first locking portion 16 comprises a first locking hole 22 opened in the joint surface 15 of the connector housing 3 opposed to the joint surface 13 of the connector housing 2. A locking edge 23 is formed on a deep side of the first locking hole 22. A slant 22*a* on which the guide slant 20*a* slides is formed on the opened edge of the first locking hole 22. The first engaging projection 14 and the first locking portion 16 are formed longer along a widthwise direction of the connector housing 2.

In a state in which the connector housings 2 and 3 are joined to each other, as shown in FIG. 6A, the first engaging projection 14 projecting from the joint surface 13 of the lower connector housing 2 is inserted into the first locking hole 22 formed in the joint surface 15 of the upper connector housing 3, the tapered portion 21 is hooked on the locking edge 23 of the first locking hole 22, thereby connecting the upper and lower connector housings 2 and 3 with each other without rattle.

In this case, the first connecting means 11 is so-called dovetail groove connecting means, and if the tapered portion 21 is hooked on the locking edge 23, a force for pulling the lower connector housing 2 toward the upper connector housing 3 is generated. With this force, the lower connector housing 2 is joined to on the upper connector housing 3 without rattle. Since the first engaging projection 14 and the first locking portion 16 are formed longer along the widthwise direction of the connector housings 2 and 3, the locking portion can be made larger, a resistance range with respect to the external force is increased correspondingly and thus, the holding force can be enhanced.

Figure 5B:
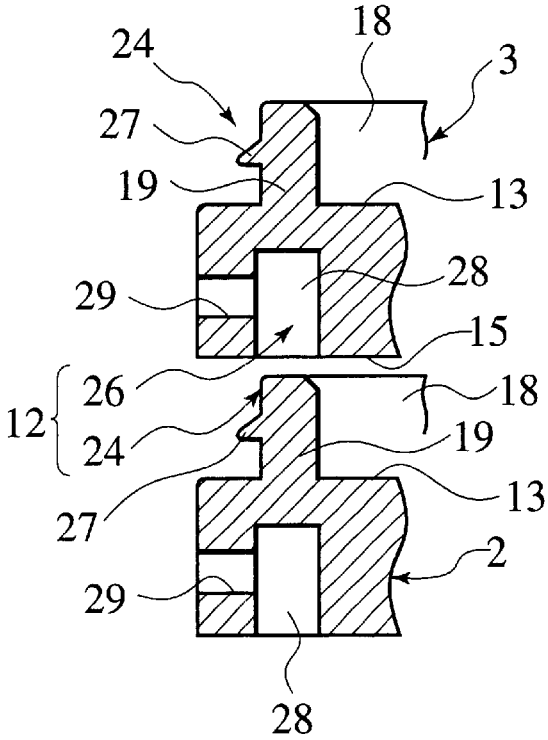
FIG. 5B is a sectional view taken along a VB—VB line in FIG. 3 for showing a state before the connector housings are laminated on one another.
Figure 6B:
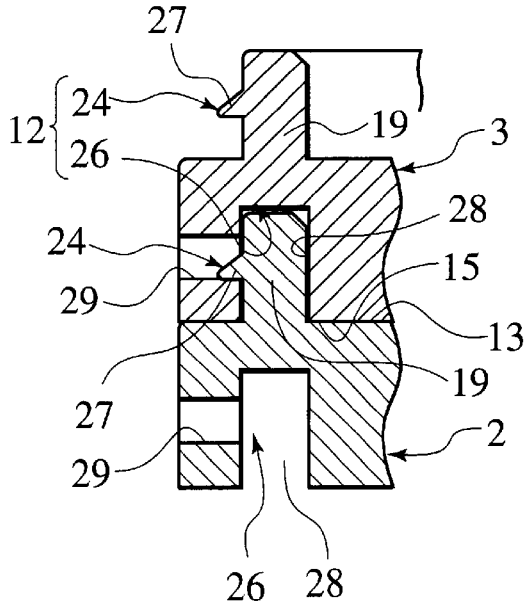
FIG. 6B is a sectional view showing second connecting means closer to the front end of the connector housing and showing a state in which the connector housings are laminated.

The second connecting means 12 comprises a second engaging projection 24 provided on the joint surface 13 of the one of the joined connector housings (lower connector housing 2), and a second locking portion 26 provided on the other connector housing (upper connector housing 3). As shown in FIGS. 5B and 6B, the second engaging projection 24 includes a hook 27 projecting from opposite sides (see FIG. 2) of the wall 19 in its widthwise direction toward the front end of the connector housing 2. The second locking portion 26 comprises a second locking hole 28 opened in the joint surface 15 of the connector housing 3 opposed to the joint surface 13 of the connector housing 2. A locking surface 29 on which the hook 27 is locked is formed on a deep side of the second locking hole 28. The locking surface 29 is formed in a direction perpendicular to a direction in which the second engaging projection 24 and the second locking portion 26 are engaged with each other.

In a state in which the connector housings 2 and 3 are joined to each other, as shown in FIG. 6B, the second engaging projection 24 projecting from the joint surface 23 of the lower connector housing 2 is inserted into the second locking hole 28 provided in the joint surface 15 of the upper connector housing 3, the hook 27 is hooked on the licking surface 29 of the second locking hole 28, thereby connecting the upper and lower connector housings 2 and 3 with each other.

In this case, the second connecting means 12 is normal connecting means in which the tapered portion is not locked to the locking edge unlike the first connecting means 11. In the case of the second connecting means 12, if the hook 27 is hooked on the locking surface 29, the connector housings 2 and 3 are merely connected with each other. Therefore, the holding force can be secured.

Next, the first and second connecting means 31 and 32 provided on the rear ends of the connector housings 2, 3 and 4 will be explained.

The first connecting means 31 provided on the rear ends of the connector housings 2 and 3 comprises a first engaging projection 34 projecting from the joint surface 13 of one of the joined connector housings (lower connector housing 2)

and a first locking portion 36 provided on the joint surface 15 of the other connector housing (upper connector housing 3).

Figure 7A:
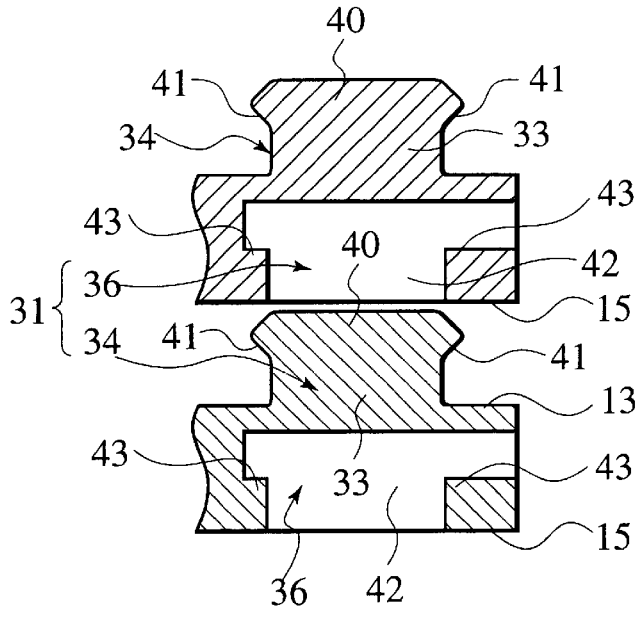
FIG. 7A is a sectional view taken along a VIIA—VIIA line in FIG. 2 for showing the first connecting means closer to a rear end of the connector housing.
Figure 8A:
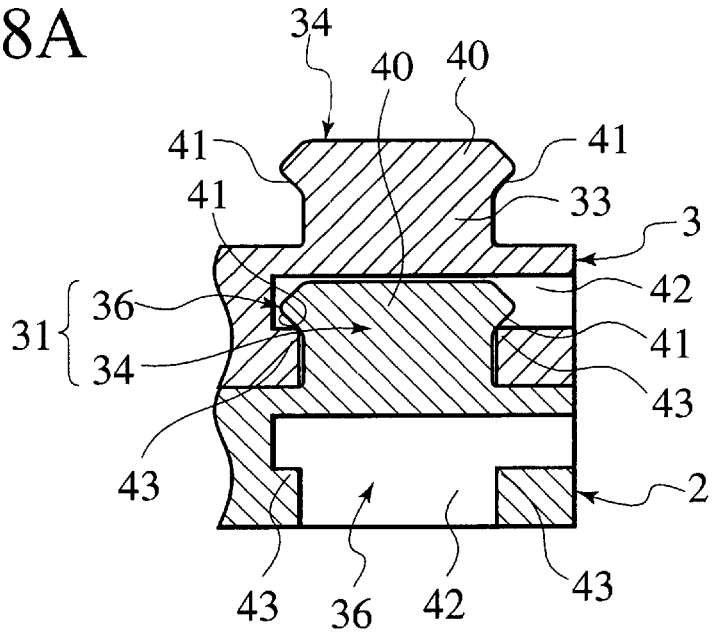
FIG. 8A is a sectional view showing first connecting means closer to a rear end of the connector housing and showing a state in which the connector housings are laminated.

As shown in FIGS. 2, 7A and 8A, the first engaging projection 34 is provided on each of opposite sides of the rear end of the connector housing 2 in its widthwise direction. One of the first engaging projections 34 in the widthwise direction of the connector housing 2 will be explained. The first engaging projection 34 includes a wall 33, a enlarged head 40 integrally provided on a tip end of the wall 33, and a tapered portion 41 provided on the side of the wall 33 of the head 40. The first locking portion 36 comprises a first locking hole 42 opened in the joint surface 15 of the connector housing 3 opposed to the joint surface 13 of the connector housing 2. A locking edge 43 is formed on a deep side of the first locking hole 42.

In the state in which the connector housings 2 and 3 are joined to each other, as shown in FIG. 8A, the first engaging projection 34 projected from the joint surface 13 of the lower connector housing 2 is inserted into the first locking portion 36 provided on the joint surface 15 of the upper connector housing 3, the tapered portion 41 is hooked on the locking edge.

In this case, the first connecting means 31 is so-called dovetail groove connecting means, and if the tapered portion 41 is hooked on the locking edge 43, a force for pulling the lower connector housing 2 toward the upper connector housing 3 is generated. With this force, the lower connector housing 2 is joined to the upper connector housing 3 without rattle.

Figure 7B:
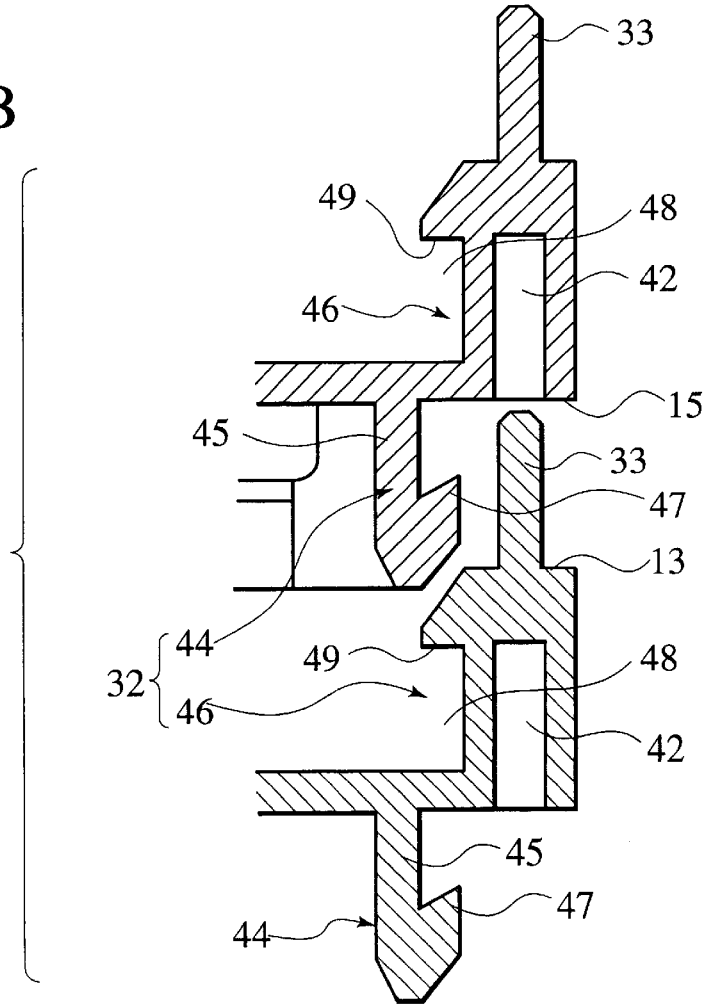
FIG. 7B is a sectional view taken along a VIIB—VIIB line in FIG. 2 for showing the second connecting means closer to a rear end of the connector housing.

The second connecting means 32 comprises a second engaging projection 44 projecting from the joint surface 15 of one the joined connector housings (upper connector housing 3) and a second locking portion 46 provided on the other connector housing (lower connector housing 2). As shown in FIGS. 2 and 7B, the second engaging projection 44 is provided on each of opposite sides of the rear end of the connector housing 3 in its widthwise direction. One of the second engaging projections 44 of the connector housing 3 in the widthwise direction will be explained. The second engaging projection 44 comprises a wall 45 projecting from the joint surface 15, and a hook 47 projecting outward of the connector housing 3 from the wall 45. The second locking portion 46 comprises a second locking portion 48 formed on each of opposite sides of the rear end of the connector housing 2 in its widthwise direction. A locking surface 49 is formed inside of the second locking portion 48 along a direction perpendicular to a direction in which the second engaging projection 44 and the second locking portion are engaged with each other.

Figure 8B:
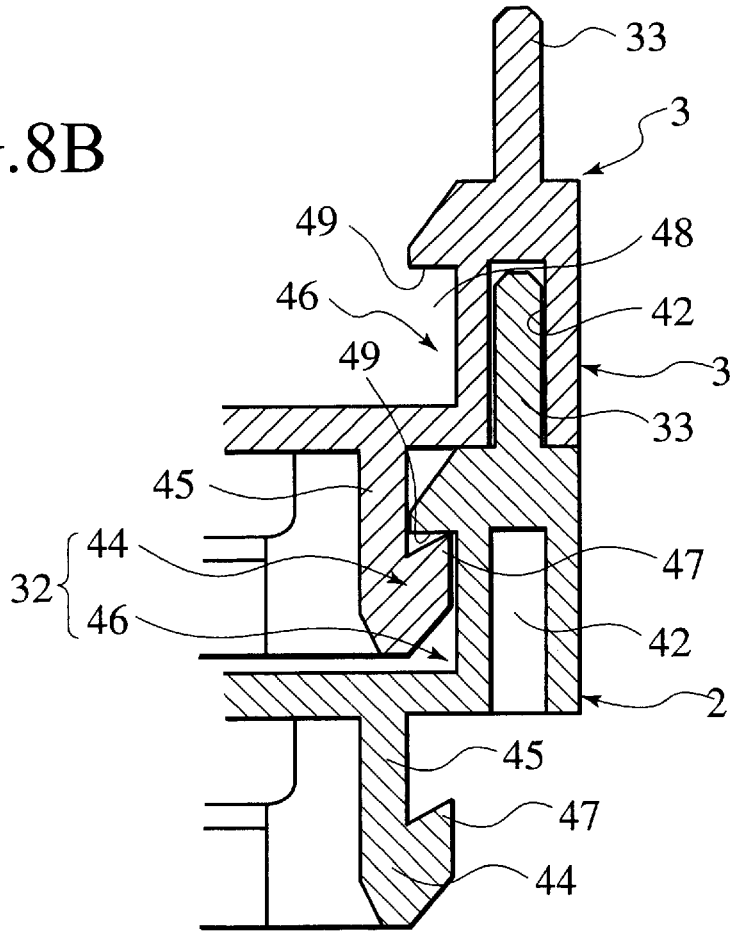
FIG. 8B is a sectional view showing second connecting means closer to the rear end of the connector housing and showing a state in which the connector housings are laminated.

In a state in which the connector housings 2 and 3 are joined to each other, as shown in FIG. 8B, the second engaging projection 44 of the upper connector housing 3 is inserted into the second locking portion 48 of the lower connector housing 2, the hook 47 is hooked on the locking surface 49, thereby connecting the connector housings 2 and 3 with each other.

In this case, the second connecting means 32 normal connecting means in which the tapered portion is not locked to the locking edge unlike the first connecting means 31. In the case of the second connecting means 32, if the hook 47 is hooked on the locking surface 49, the connector housings 2 and 3 are merely connected with each other.

According to the present embodiment, if the plurality of the connector housings 2, 3 and 4 are joined to one another, they are connected to each other and coalesced by means of the first and second connecting means 11 and 12 on the front ends of the connector housings 2, 3, 4 and by means of the first and second connecting means 31 and 32 on the rear ends of the connector housings 2, 3, 4. In this case, the first connecting means 11 and 31 are so-called dovetail groove connecting means in which the tapered portions 21 and 41 of the first engaging projections 14 and 34 are locked to the first locking portions 16 and 36, respectively. Therefore, the connector housing 2, 3 and 4 are connected to one another without rattle. Further, the second connecting means 12 and 32 are so-called normal locking means in which the hooks 27 and 47 of the second engaging projections 24 and 44 are locked to the locking surfaces 29 and 49, respectively. Therefore, the joined connector housings are strongly connected. Thus, the connector housings are strongly held by the first connecting means 11 and 31 as well as the second connecting means 12 and 32.

Even if an external force for trying to separate the joined connector housings 2, 3 and 4 is applied from any direction, since the first connecting means 11, the second connecting means 12, as well as the first connecting means 31 and the second connecting means 32 are disposed adjacent to each other on the side of the front ends and rear ends of the connector housings 2, 3 and 4, these connector housings 2, 3 and 4 are not separated accidentally.

Further, the front end side first connecting means 11 is formed longer along the widthwise direction of the connector housings 2, 3 and 4, and the rear end second connecting means 32 is formed longer in the longitudinal direction of the connector housings. Therefore, the number of locking portions between the first engaging projection 14 and the first locking portion 16 as well as between the second engaging projection 44 and the second locking portion 46 is increased, a resistance range with respect to the external force is increased correspondingly and thus, the rattle-preventing force and the holding force can be enhanced.

What is claimed is:

1. A connector connecting structure for connecting a plurality of connector housings to be joined, comprising:

first connecting means comprising a first engaging projection having an enlarged head formed on a tip end of a wall projecting from one surface of one of said connector housings and having a tapered portion formed on the side of said wall, and a first locking portion provided on the other surface of the other connector housing opposed to said one surface of said one connector housing and said tapered portion being locked to said first locking portion in a state in which said connector housings are joined to each other; and a second connecting means comprising a second engaging projection provided on one surface on any one of said connector housings and having a hook, and a second locking portion provided on the other surface of the other connector housing opposed to one surface of any one of said connector housings, said hook being locked to said second locking portion in a state in which said connector housings are joined to each other, said second locking portion having a locking surface perpendicular to an engaging direction.

2. A connector connecting structure according to claim 1, wherein said first and second connecting means are provided on front and rear ends of said connector housings in a state in which said first and second connecting means are adjacent to each other.

3. A connector connecting structure for connecting a plurality of connector housings to be joined, comprising:

first connecting means comprising a first engaging projection having an enlarged head formed on a tip end of a wall projecting from one surface of one of said connector housings and having a tapered portion formed on the side of said wall, and a first locking portion provided on the other surface of the other connector housing opposed to said one surface of said one connector housing and said tapered portion being locked to said first locking portion in a state in which said connector housings are joined to each other; and a second connecting means comprising a second engaging projection provided on one surface on any one of said connector housings and having a hook, and a second locking portion provided on the other surface of the other connector housing opposed to one surface of any one of said connector housings, said hook being locked to said second locking portion in a state in which said connector housings are joined to each other, said second locking portion having a locking surface perpendicular to an engaging direction, wherein said first and second connecting means are provided on front and rear ends of said connector housings in a state in which said first and second connecting means are adjacent to each other, and wherein said first connecting means on the side of the front end of said connector housing is formed longer along a widthwise direction of said connector housing, and said second connecting means on the side of the rear end is formed longer along a longitudinal direction of said connector housing.

* * * * *